US005945055A

United States Patent [19]

Inamura

[11] Patent Number: 5,945,055

[45] Date of Patent: Aug. 31, 1999

[54] PROCESS FOR MAKING A FILAMENT FROM A POLYESTER-POLYPROPYLENE BLEND

[75] Inventor: Toshiaki Inamura, Toyama-ken, Japan

[73] Assignee: YKK Corporation, Tokyo, Japan

[21] Appl. No.: 09/004,314

[22] Filed: Jan. 8, 1998

Related U.S. Application Data

[62] Division of application No. 08/917,612, Aug. 26, 1997, Pat. No. 5,763,077, which is a continuation of application No. 08/506,976, Jul. 28, 1995, abandoned.

[30] Foreign Application Priority Data

Aug. 3, 1994 [JP] Japan ..... 6-200310

[51] Int. Cl.[6] ..... D01D 5/12; D01D 10/02; D01F 6/36

[52] U.S. Cl. ..... 264/210.5; 264/210.7; 264/210.8; 264/211.17; 264/235.6; 264/342 RE

[58] Field of Search ..... 264/210.5, 210.7, 264/210.8, 211.17, 235.6, 342 RE

[56] References Cited

U.S. PATENT DOCUMENTS

| | | |
|---|---|---|
| 3,137,989 | 6/1964 | Fior et al. . |
| 3,223,752 | 12/1965 | Tate et al. . |
| 3,256,363 | 6/1966 | Horn et al. . |
| 3,359,344 | 12/1967 | Fukushima et al. . |
| 3,361,848 | 1/1968 | Siggel et al. . |
| 3,419,638 | 12/1968 | Fuzek . |
| 3,431,322 | 3/1969 | Caldwell et al. . |
| 3,707,837 | 1/1973 | Gibbon . |
| 3,719,729 | 3/1973 | Le Paranthoen et al. . |
| 3,944,699 | 3/1976 | Mathews et al. . |
| 4,036,003 | 7/1977 | Lowder et al. . |
| 4,123,490 | 10/1978 | Gibbon . |
| 4,179,875 | 12/1979 | Gibbon . |
| 4,368,295 | 1/1983 | Newton et al. . |
| 4,460,729 | 7/1984 | Books . |
| 4,463,121 | 7/1984 | Gartland et al. . |
| 4,547,420 | 10/1985 | Krueger et al. . |
| 4,963,430 | 10/1990 | Kish et al. . |
| 5,281,668 | 1/1994 | Heggs et al. . |

FOREIGN PATENT DOCUMENTS

| | | | |
|---|---|---|---|
| 600359 | 2/1961 | Belgium . | |
| 2158025 | 10/1972 | France . | |
| 2531622 | 7/1975 | Germany . | |
| 2458071 | 6/1976 | Germany | 264/210.8 |
| 3113717 | 4/1981 | Germany . | |

OTHER PUBLICATIONS

Abstract of Japan 54–121,887 (Published Sep. 21, 1979).

*Primary Examiner*—Leo B. Tentoni
*Attorney, Agent, or Firm*—Finnegan, Henderson, Farabow, Garrett & Dunner, L.L.P.

[57] ABSTRACT

A method for making linear materials for fasteners, particularly monofilaments, which possess pearly luster and retain this pearly luster intact even after being dyed. A polyester, particularly polyethylene terephthalate, is blended with 1 to 10% by weight of polypropylene and the resultant blend is subjected to melt spinning. The undrawn filament thus obtained possesses pearly luster and can be used as a raw material for fastener parts presenting an appearance of high quality. The undrawn filament has the dyeability thereof adjusted without noticeably affecting the degree of shrinkage when it is drawn at a temperature in the range of from 70 to 98° C. Thus, the monofilaments for fasteners, which possess pearly luster and are allowed to be dyed in colors harmonized with the colors of fastener tapes, can be produced.

7 Claims, 1 Drawing Sheet

PROCESS FOR MAKING A FILAMENT FROM A POLYESTER-POLYPROPYLENE BLEND

This is a division of Ser. No. 08/917,612, filed Aug. 26, 1997, now U.S. Pat. No. 5,763,077, issued Jun. 9, 1998, which is a continuation of Ser. No. 08/506,976, filed Jul. 28, 1995, now abandoned.

BACKGROUND OF THE INVENTION

1. Field of the Invention

This invention relates to linear materials for fasteners, which are endowed with pearly luster and a method for the production thereof.

2. Description of the Prior Art

Polyester monofilaments, particularly polyethylene terephthalate monofilaments, have been heretofore used for fasteners because they possess many excellent properties. The main parts of a fastener are a pair of tapes and fastening elements attached to the tapes (components for joining the tapes). In the case of a slide fastener, for example, the elements are made of a monofilament in a coiled or zig-zagged shape. In some of the conventional slide fasteners, tapes and elements are so prepared that they assume a practically equal color after they are separately dyed prior to assembling. In others, tapes and elements are made of monofilaments so colored with pigments that they assume a varied combination of colors.

In the case of a slide fastener produced in one and the same color, notwithstanding the tapes and the elements thereof have undergone the same dyeing treatment, the color consequently assumed by the tapes is variable with the material of threads forming the tapes and the texture formed by weaving. For the purpose of dyeing the elements in a color matching the color of the tapes, therefore, it is necessary that the dyeability or dye-affinity of the elements be controlled. The control of the dyeability of the elements has been generally implemented by adjusting the draw ratio of the monofilament thereby varying the degree of orientation of the monofilament or by adjusting the temperature of the final heat treatment thereby varying the degree of crystallization or crystallinity.

These methods, however, are at a disadvantage in suffering the elements to incur notable dimensional variation during the forming thereof because the changes in conditions of drawing or temperatures of heat treatment caused on the monofilament notably vary the physical properties, particularly the degree of shrinkage, of the monofilament. For the purpose of imparting highly desirable quality to the produced elements, therefore, the degree of shrinkage of the monofilament and consequently the conditions of drawing or the temperatures of heat treatment to be employed are restricted invariably at the sacrifice of the dyeability and consequently the equality of color.

Incidentally, for the purpose of enabling the fasteners such as slide fasteners and hook-and-loop fasteners, particularly their elements, to present an appearance of high quality, the practice of imparting pearly luster thereto has been in vogue. As means to effect this impartation of pearly luster, a method which resides in adding a pigment capable of conferring a pearly color tone (hereinafter referred to as "pearlescent pigment") is popular. In the case of a linear material for a fastener, especially a monofilament as a raw material for fastener elements, when the pigment is added thereto in the proportion of not less than about 3%, the elements in an undyed state indeed acquire a pearly luster. When these elements are dyed, however, they are not fully colored by the dyeing because the added pearlescent pigment has degraded the dyeability thereof and the color of the monofilament itself has already been turned to opaque white by the pigment. Thus, the elements are dyed very poorly as compared with the tapes of the fastener and the pearly luster imparted thereto is likewise inferior. As a result, the tapes and the elements of a fastener cannot be dyed in matched colors and the produced fastener is deficient in commercial value.

As another means to effect the impartation of pearly luster, a method which consists in mixing a coloring pigment with the pearlescent pigment has been known. According to this method, though the monofilaments are obtained indeed as colored in pearly tones, the production of fasteners in such a huge number of colors as 200 to 300 is difficult to achieve from the practical point of view and is unduly expensive.

SUMMARY OF THE INVENTION

A primary object of the present invention, therefore, is to find out a linear material for a fastener, which is endowed with a heretofore unattainable pearly luster without requiring use of a coloring pigment and allowed to retain this pearly luster after being dyed.

A more specific object of the present invention is to provide a linear material for a fastener, particularly a monofilament, of highly desirable quality excelling in mechanical strength, formability, and dyeability and possessing pearly luster and a method for the production thereof.

Another object of the present invention is to provide a linear material for fastener elements, particularly in the form of a monofilament, which allows the dyeability thereof to be controlled without substantially affecting the physical properties, particularly the degree of shrinkage, thereof even when the dyeability of fastener tapes is varied because of alteration of the fastener tape material and which can be dyed simultaneously with the fastener tapes and a method for the production thereof.

To accomplish the objects described above, the present invention provides a linear material for a fastener, which is made of a polymer blend comprising a polyester and 1 to 10 parts by weight, based on 100 parts by weight of the polyester, of polypropylene.

When this linear material is used as fastener parts such as, for example, fastener elements which are required to possess strength, the polyester used in the linear material is desired to possess an intrinsic viscosity or limiting viscosity number in the range of from 0.60 to 1.00.

The present invention also provides a method adapted for the production of a linear material for a fastener, particularly a monofilament for fastener elements, obtained by drawing a filament formed by a melt spinning process. This method comprises mixing a polyester with 1 to 10 parts by weight, based on 100 parts by weight of the polyester, of polypropylene, melting and extruding the resultant mixture to obtain a filament, and drawing the resultant undrawn filament at a temperature in the range of from 70 to 98° C.

BRIEF DESCRIPTION OF THE DRAWINGS

Other objects, features, and advantages of the invention will become apparent from the following description taken together with the drawings, in which.

DETAILED DESCRIPTION OF THE INVENTION

Figure 1:
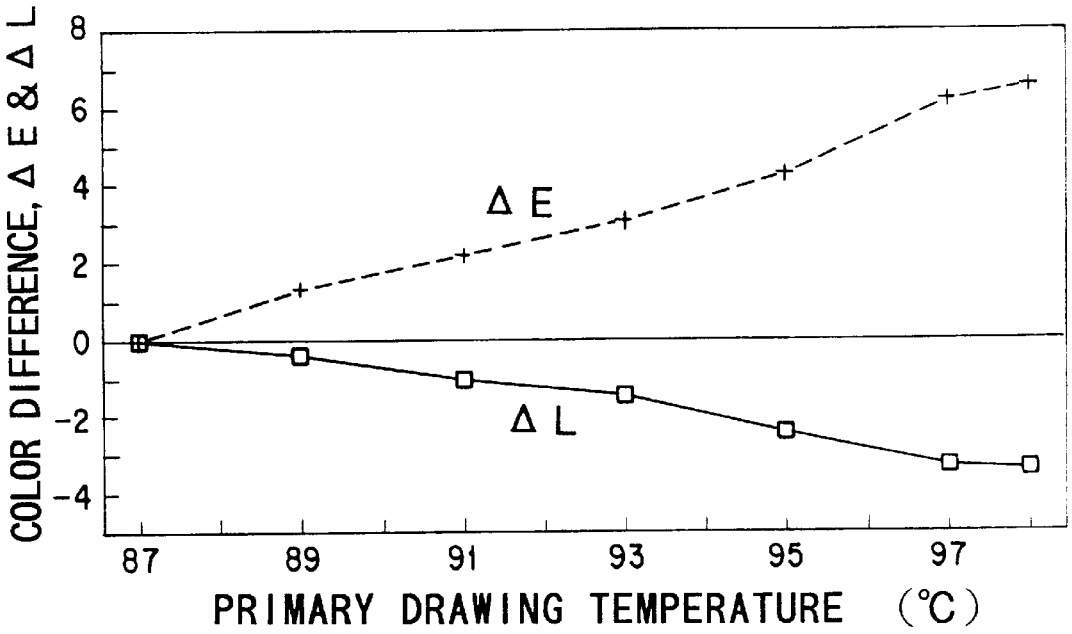
FIG. 1 is a graph showing the relations between the drawing temperature and the color difference ($\Delta E$) as well as the lightness difference (ΔL) of a monofilament produced in accordance with the present invention.

The present inventor has found that when a polymer blend combining 100 parts by weight of a polyester with 1 to 10 parts by weight of polypropylene is used as the raw material for such linear materials for fasteners as monofilaments to be used for coiled or zigzagged elements in slide fasteners, reinforcing film for top end pieces and bottom end pieces in fasteners, multifilaments for fasteners, undrawn filaments for use as machine sewing threads, core cords, fastener tapes, and male members (hook elements for engagement with piles or loops of female members) in hook-and-loop fasteners, there is obtained a linear material for fasteners, which is endowed with a heretofore unattainable pearly luster without requiring use of a coloring pigment and allowed to retain this pearly luster after being dyed. This linear material excels in formability and dyeability. When the polyester to be used in the linear material possesses an intrinsic viscosity in the range of from 0.60 to 1.00, this linear material can be used advantageously in such parts as fastener elements which are required to excel in mechanical strength.

By the present inventor's further study, it has been found that when the undrawn filament obtained from the polymer blend mentioned above is drawn or stretched at a temperature in the range of from 70 to 98° C. (the drawing of the first stage in the case of multi-stage drawing), the dyeability of the filament can be controlled without substantially varying the degree of shrinkage. To be specific, the dyeability of the linear material can be controlled by using a hot stretching bath (hot water) for the drawing of the first stage and changing the drawing temperature between 70° C. and 98° C. As a result, the linear material for fasteners and the fastener tapes can be simultaneously dyed to mutually matched color simply by varying the temperature of the linear material during the process of drawing even when the dyeability of the tapes is varied by an alteration of the fastener tape material. Thus, a fastener having harmonized pearly luster can be obtained.

Now, the present invention will be described in detail below. As the linear material for fasteners, the present invention uses a polymer blend resulting from blending a polyester such as, for example, polyethylene terephthalate (hereinafter referred to briefly as "PET"), polybutylene terephthalate, or polycarbonate with 1 to 10% by weight of polypropylene (hereinafter referred to briefly as "PP"). Since the polyester and the PP are deficient in compatibility, the allowable PP content in the polymer blend is small. When the polymer blend is extruded, however, the surface of the extruded blend emits a highly desirable pearly luster. If the amount of the PP to be added is less than 1% by weight, the pearly luster will not be sufficient. Conversely, if this amount exceeds 10% by weight, the polymer blend will incur heavy loss of strength and the drawn linear material, particularly a monofilament, will encounter uneven drawing because of poor compatibility of the PP with the polyester and, as a result, the drawn filament will suffer from lack of uniformity of diameter and will prove unusable for fasteners. In consideration of the balance of luster of the produced linear material and the balance of allowable diameter of the filament (dispersion of diameter ±15/1000 mm), the amount of polypropylene to be added is desired to be in the range of from 2 to 5% by weight. The term "monofilament" as used in this specification refers to a filament formed from one single synthetic fiber.

When the linear material is used for fastener parts which are required to offer high mechanical strength, namely when it is a monofilament to be used for coiled or zigzagged elements, for example, the polyester to be used is desired to have an intrinsic viscosity in the range of from 0.60 to 1.0. If the intrinsic viscosity is less than 0.60, the linear material will fail to acquire strength enough to withstand the load exerted on a fastener, for example. Conversely, if the intrinsic viscosity exceeds 1.0, the material will be at a disadvantage in acquiring too high viscosity to be smoothly melted and extruded. The intrinsic viscosity indicated herein has been found with a solution prepared by dissolving a given polyester sample in a mixed solvent of phenol and tetrachloroethane in the weight ratio of 1:1 at 25° C.

In the production of the linear material for fasteners in accordance with the present invention, first for the purpose of blending the PP with the polyester, mainly PET, preparatorily to the melt extrusion, they are mixed with the aid of a twin-cylinder mixer or the like and the resultant mixture is subsequently dried. Otherwise, the polyester and the PP which have been already dried are mixed immediately prior to the extrusion by the use of an automatic master batch blender (for example, product of KAWATA MFG. CO., LTD. marketed under trade name of "Autocolor") by way of pretreatment.

For the purpose of obtaining the linear material for fasteners, particularly a polyester monofilament, as contemplated by the present invention, it is important that the polyester and the PP be thoroughly mixed inside an extruder. It is desirable to increase the kneadability of these resins by disposing an extruder screw provided with a mixing head on the leading end part thereof in an extruder or by disposing a static mixer within a passageway for molten resins.

Then, an undrawn filament is obtained by extruding the melt of resin mixture under suitably adjusted melt spinning conditions. The undrawn filament is manufactured, for example, by melting and discharging the PP-blended PET having an intrinsic viscosity in the range of from 0.60 to 1.00 at a temperature in the range of from 290 to 300° C., immediately cooling and solidifying the discharged filament, and meanwhile taking up the solidified filament at a speed in the range of from 10 m/minute to 30 m/minute. The undrawn filament thus obtained can be used as the raw material for such linear materials for fasteners as monofilaments to be used for coiled or zigzagged elements in slide fasteners, reinforcing film for top end pieces and bottom end pieces in fasteners, multi-filaments for fasteners, undrawn filaments for use in machine sewing threads, core cords, fastener tapes, and fastener elements for hook-and-loop fasteners, for example.

The linear materials, particularly monofilaments, to be further drawn such as the monofilaments to be used for fastening elements of slide fasteners and hook-and-loop fasteners and reinforcing films for the top and the bottom end pieces in fasteners are obtained by drawing the undrawn filaments produced as described above to 3.0 to 4.5 times their lengths at a temperature in the range of from 70 to 98° C. and further heat-treating the drawn filaments in a relaxed state at a temperature in the range of from 200 to 270° C.

Otherwise, after said primary drawing, the monofilaments aimed at are obtained by again drawing the initially drawn filaments to 1.2 to 1.8 times their lengths with dry heat at a temperature in the range of from 150 to 240° C. and subjecting the re-drawn filaments to the heat treatment in the relaxed state mentioned above.

As respects the dyeability of the heretofore known material, since adjustment of the dyeability of a monofilament resulted in heavy fluctuation of the physical properties, particularly the degree of shrinkage, of the monofilament, the range of the degree of shrinkage allowing easy formation of elements was surpassed at times. After a diligent study, the present inventor has succeeded in varying the dyeability of the monofilament without entailing a noticeable fluctuation of the degree of shrinkage by varying the temperature during the process of the primary drawing within the range of from 70 to 98° C. Any deviation of the temperature from the aforementioned range is undesirable because the filament being drawn will tend to sustain breakage if the drawing temperature is lower than 70° C. Conversely, if it exceeds 98 ° C., the hot water in the drawing bath will tend to boil and emit bubbles and the monofilament being drawn will have the dyeability thereof affected in the portions thereof which are exposed to the bubbles.

Then as respects the draw ratio, since the dyeability of the polyester has been already degraded slightly owing to the addition of the PP thereto, it is undesirable to lower the dyeability further by drawing the undrawn filament at a high ratio. On the other hand, since the addition of the PP lowers the strength of the monofilament, it becomes necessary to increase the draw ratio to make up for the loss of the strength.

The method of production according to the present invention, therefore, first raises the draw ratio for the purpose of enhancing the strength lowered by the addition of the PP and then controls the dyeability of the monofilament by the drawing temperature for the purpose of matching this dyeability with the dyeability of the fastener tape part. Specifically, the temperature for the primary drawing is heightened when the deepening of the color of the monofilament is desired or lowered when the thinning of the color is desired. In consequence of the control of the dyeability of the monofilament effected as described above, there is obtained a monofilament for a fastener, which is satisfactory in terms of dyeability and mechanical strength.

As described above, the linear material for a slider according to the present invention uses as its raw material a polymer blend comprising 100 parts by weight of a polyester, preferably a polyester having an intrinsic viscosity in the range of from 0.60 to 1.0, and 1 to 10 parts by weight of polypropylene. Thus, this linear material possesses a heretofore unattainable pearly luster and keeps this pearly luster intact after being dyed. It further excels in mechanical strength, formability and dyeability.

Further, according to the method of the present invention for the production of a linear material for a fastener, particularly a monofilament, the dyeability of the monofilament itself can be varied without noticeably affecting the physical properties, particularly the degree of shrinkage, of the monofilament by varying the temperature at the time of drawing. As a result, the monofilament can be dyed in a color harmonized to the color of tapes even when the dyeability of the tapes is varied by an alteration of the tape material. Moreover, since the pearly luster is not destroyed by the dyeing, the monofilaments can be dyed in a huge number of colors. The monofilaments can be dyed simultaneously with tapes unlike the coloration with pearlescent pigment. The drawing causes virtually no dispersion in filament diameter. Thus, the linear material of the present invention can be utilized advantageously for fastener parts, particularly fastening elements.

Now, the present invention will be described more specifically below with reference to working examples.

Examples 1 to 5 and Comparative Examples 1 to 5:

A blend of PET and PP having a varying PP content as shown in the Table was melted and extruded at a temperature in the range of from 290 to 300° C., immediately cooled and solidified, and meanwhile taken up at a rate of 16 m/min to produce an undrawn filament. Then, the produced undrawn filament was drawn to 3.3 times its length in hot water kept at a varying temperature indicated in the Table, then again drawn to 1.7 times the increased length with dry heat at 175 ° C., and thereafter subjected in a relaxed state to a heat treatment at 265° C. to obtain a monofilament aimed at. Subsequently, the monofilament thus obtained was batchwise dyed to red in a disperse dye (product of SANDOZ Chemicals LTD. marketed under trade name of "Foron® Red RD-519") at 130° C. for 40 minutes.

In Examples 1 to 3 and Comparative Examples 1 and 2, monofilaments of varying dyeability were trially manufactured by varying the PP contents in the relevant PET monofilaments and tested. In Examples 1, 4, and 5, monofilaments were obtained at a varying temperature for primary drawing and were similarly tested. In Comparative Examples 3 to 5, monofilaments were trially manufactured by following the procedure described above while using blends having nylon 6, polybutylene terephthalate (PBT), or pearlescent pigment in the place of PP added to PET and were similarly tested. The results are shown in the Table.

TABLE

| No. | PP content (wt %) | Temp. for primary drawing (° C.) | Dispersion of filament diameter (mm) | Pearly luster | Dyeability (L value) when dyed to red | Evaluation |
|---|---|---|---|---|---|---|
| Examples | | | | | | |
| 1 | 3 | 87 | Less than ±1/100 | ○ | 41.94 | Good |
| 2 | 5 | 87 | Less than ±1/100 | ○ | 43.63 | Good |
| 3 | 10 | 87 | Less than ±3/100 | ○ | 45.40 | Somewhat good |
| 4 | 3 | 93 | Less than | ○ | 38.62 | Good |

TABLE-continued

| No. | PP content (wt %) | Temp. for primary drawing (° C.) | Dispersion of filament diameter (mm) | Pearly luster | Dyeability (L value) when dyed to red | Evaluation |
|---|---|---|---|---|---|---|
| | | | ±1/100 | | | |
| 5 | 3 | 98 | Less than ±1/100 | ○ | 34.09 | Good |
| Comparative Examples | | | | | | |
| 1 | 0 | 87 | Less than ±1/100 | x | 31.84 | No pearly appearance |
| 2 | 15 | 87 | ±12/100 | ○ | 46.89 | Non-uniform filament diameter |
| 3 | Addition of 3 wt % Nylon 6 | 87 | Less than ±1/100 | x | 37.55 | No pearly appearance |
| 4 | Addition of 3 wt % PBT | 87 | Less than ±1/100 | x | 28.63 | No pearly appearance |
| 5 | Addition of 3 wt % Pearlescent pigment | 87 | Less than ±1/100 | ○ | 58.76 | Poor dyeability |

The data given under the titles indicated in the Table are the results of determination by the following methods.

(1) Dispersion of Filament Diameter

On a 100-cm sample of a given monofilament, diameters were measured at five points separated by 10 cm by the use of a dial thickness gauge (product of Peacock K. K. marketed under product code of "Model G") and the dispersion was calculated on the basis of the maximum and the minimum diameter obtained by the measurement.

(2) Pearly Luster

A bundle of six given monofilaments about 20 cm in length was visually examined to rate the pearly luster on the three-point scale, wherein ○ stands for pearly luster, Δ for slight pearly luster, and x for no pearly luster.

(3) Dyeability (L Value)

A given monofilament dyed in red was cut to prepare 30 pieces 3 cm in length. The cut samples were stuck as closely adjoined on an adhesive tape. The arranged monofilament sample thus obtained was tested for "L" value, "a" value, and "b" value with a calorimeter (product of Minolta K. K. marketed under product code of "CR-200"). The depth of color was rated with the "L" value. The "L" value means a psychometric lightness, and "a" value and "b" value mean psychometric chroma coordinates in the Hunter's color difference formula.

It is clearly remarked from the Table that the monofilaments of Examples 1 to 5 whose PP contents were in the range of from 3 to 10% by weight produced highly desirable results in all the items of rating. Comparison of the results of Examples 1, 4, and 5 clearly reveals that the dyeability (depth of color) could be varied by varying the temperature for the primary drawing.

In contrast, the monofilament of Comparative Example 1 which contained no PP produced no pearly luster and the monofilament of Comparative Example 2 whose PP content exceedes 10% by weight showed heavy dispersion of filament diameter and inferior dyeability. The monofilaments of Comparative Examples 3 and 4 which contained nylon 6 or PBT instead of PP produced no pearly luster and the monofilament of Comparative Example 5 which incorporated pearlescent pigment betrayed very inferior dyeability.

Figure 2:
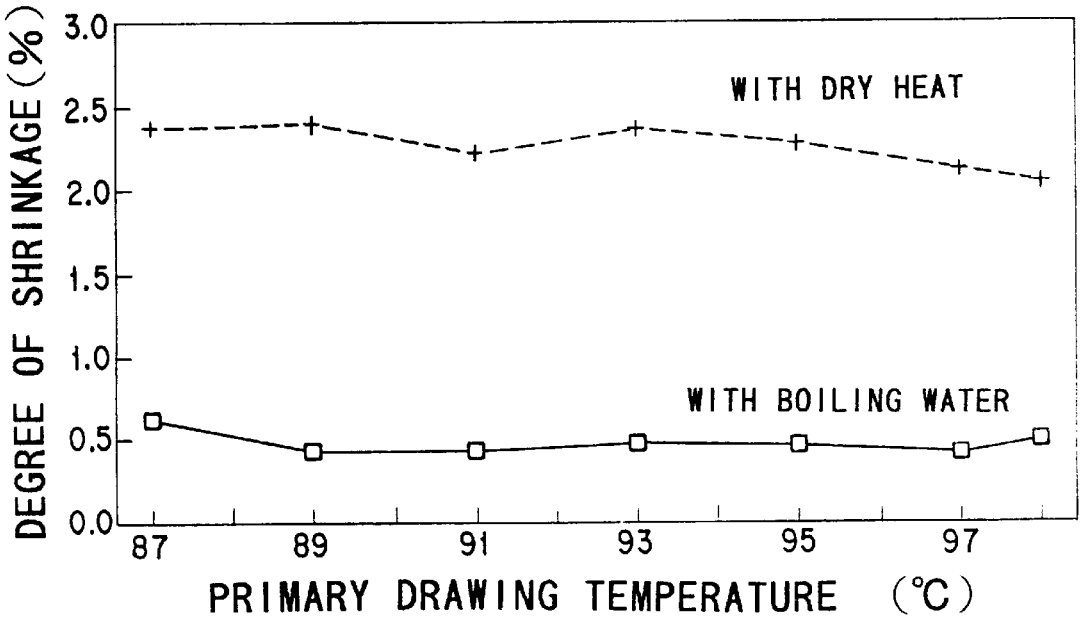
FIG. 2 is a graph showing the relations between the drawing temperature and the degree of shrinkage with boiling water as well as the degree of shrinkage with dry heat of a monofilament produced in accordance with the present invention.

Then, monofilaments were produced by following the procedures of the working examples cited above while fixing the PP content at 3% by weight. They were tested to determine the relations between the temperature of drawing and the dyeability as well as the degree of shrinkage. The results are shown in FIG. 1 and FIG. 2. In FIG. 1, the symbol "ΔE" means a color difference in accordance with the Hunter's color difference formula.

FIG. 1 indicates that the color difference, ΔE and lightness difference, ΔL of a produced monofilament can be controlled by varying the drawing temperature. From the curve of the color difference, ΔE shown in FIG. 1, it is inferred that the color of a produced monofilament can be darkened (in a blackish tint) by heightening the drawing temperature. The lightness difference, A L shows the degree of color difference to be produced based on the color difference, ΔE. To be specific, the color of tapes and that of a monofilament can be freely controlled by controlling the drawing temperature of the monofilament in conformity to the dyed tapes. For example, they may be given one and the same color tone.

FIG. 2 shows the results of a test carried out on monofilaments produced by drawing at temperatures indicated on the axis of abscissae of the diagram with respect to the degree of shrinkage with boiling water (degree of shrinkage after the step of cooling which followed 30 minutes' immersion in boiling water) or the degree of shrinkage with dry heat (degree of shrinkage after the step of cooling which followed 30 minutes' heating at 180° C.). It is clearly noted from the results shown in FIG. 2 that the monofilaments produced in accordance with the method of the present invention show only small changes in their degree of shrinkage.

FIG. 1 and FIG. 2, therefore, indicate that by changing the drawing temperature in the range of from 70° C. to 98° C. in accordance with the present invention, dyed monofilaments can be given freely changed color tones and products using these monofilaments show only a small variation or no variation in the degree of shrinkage.

While certain specific working examples have been disclosed herein, the invention may be embodied in other specific forms without departing from the spirit or essential characteristics thereof. The described examples are therefore to be considered in all respects as illustrative and not restrictive, the scope of the invention being indicated by the appended claims rather than by foregoing description and all changes which come within the meaning and range of equivalency of the claims are, therefore, intended to be embraced therein.

What is claimed is:

1. A method for the production of a filament for a fastener, comprising the steps of:

mixing a polyester with 1 to 10 parts by weight, based on 100 parts by weight of said polyester, of polypropylene;

melting the resultant mixture;

extruding the resultant melt to obtain a filament; and drawing the resultant undrawn filament at a temperature in the range of from 70 to 98° C.

2. The method according to claim 1, wherein said undrawn filament is drawn at a temperature in the range of from 70 to 98° C., then heat-treated in a relaxed state at a temperature in the range of from 200 to 270° C., further drawn at a temperature in the range of from 150 to 240° C., and thereafter further subjected to said heat treatment in the relaxed state.

3. The method according to claim 1, wherein said melt of polyester and polypropylene is extruded at a temperature in the range of from 290 to 300° C. and immediately cooled and solidified to obtain a filament.

4. The method according to claim 1, wherein said polyester possesses an intrinsic viscosity in the range of from 0.60 to 1.00.

5. The method according to claim 1, wherein said polyester is selected from the group consisting of polyethylene terephthalate, polybutylene terephthalate, and polycarbonate.

6. A method for the production of a monofilament endowed with pearly luster, comprising the steps of:

preparing a melt of a polymer blend comprising a polyester which possesses an intrinsic viscosity in the range of from 0.60 to 1.00 and 1 to 10 parts by weight, based on 100 parts by weight of said polyester, of polypropylene;

extruding said melt at a temperature in the range of from 290 to 300° C. in the form of a monofilament;

cooling the extruded monofilament to solidify it;

drawing the monofilament to 3.0 to 4.5 times the original length in hot water at a temperature in the range of from 70 to 98° C.;

subjecting the drawn monofilament to a heat treatment in a relaxed state at a temperature in the range of from 200 to 270° C.;

further drawing the drawn monofilament to 1.2 to 1.8 times the length of the drawn monofilament with dry heat at a temperature in the range of from 150 to 240° C.; and further subjecting the drawn monofilament to a heat treatment in a relaxed state at a temperature in the range of from 200 to 270° C.

7. The method according to claim 6, wherein said polyester is selected from the group consisting of polyethylene terephthalate, polybutylene terephthalate, and polycarbonate.

* * * * *